US006138864A

United States Patent [19]

Enochs

[11] Patent Number: 6,138,864

[45] Date of Patent: Oct. 31, 2000

[54] UTILITY CLOSURE FOR MUD BUCKET

[76] Inventor: William R. Enochs, 9780 Conrad Rd., Harrisburg, Mo. 65256

[21] Appl. No.: 09/314,905

[22] Filed: May 20, 1999

[51] Int. Cl.[7] ..... B65D 85/20; B65D 51/04

[52] U.S. Cl. ..... 220/845; 220/23.4; 220/694; 206/373; 211/70.6; 248/230.8; 248/295.11

[58] Field of Search ..... 220/845, 846, 220/848, 23.4, 694, 697, 735, 736, 740, 379; 206/373, 372, 234; 211/70.6, 86.01; 248/110, 111, 214, 147, 295.11, 230.8, 213.2

[56] References Cited

U.S. PATENT DOCUMENTS

| | | | |
|---|---|---|---|
| 1,214,502 | 2/1917 | Becker . | |
| 2,939,604 | 6/1960 | Falk | 220/845 |
| 3,065,858 | 11/1962 | Furr . | |
| 4,211,455 | 7/1980 | Tedrow | 206/373 X |
| 4,356,916 | 11/1982 | Anglemyer | 206/373 X |
| 4,826,007 | 5/1989 | Skeie | 206/373 |
| 5,385,258 | 1/1995 | Sutherlin | 220/845 |
| 5,404,611 | 4/1995 | Raney | 220/697 X |
| 5,437,369 | 8/1995 | Spitere | 206/373 |
| 5,503,571 | 4/1996 | Cheslock | 206/373 X |
| 5,626,272 | 5/1997 | Klemansky | 206/373 X |
| 5,683,009 | 11/1997 | King | 220/697 X |
| 5,816,549 | 10/1998 | Anderson | 248/213.2 |
| 5,833,095 | 11/1998 | Russell et al. | 206/373 X |
| 5,913,450 | 6/1999 | Runkel | 220/697 X |

*Primary Examiner*—Nathan J. Newhouse

*Attorney, Agent, or Firm*—Polster, Lieder, Woodruff & Lucchesi, L.C.

[57] ABSTRACT

A utility closure for a mud bucket or the like has a rigid bar, a tool holder connected to the bar, a hinge having a leaf carried by the bar and a leaf fastened to a lid, and a releasable fastener for securing the bar, mediately or immediately to the bucket.

13 Claims, 4 Drawing Sheets

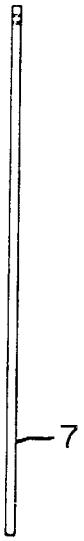
FIG. 4
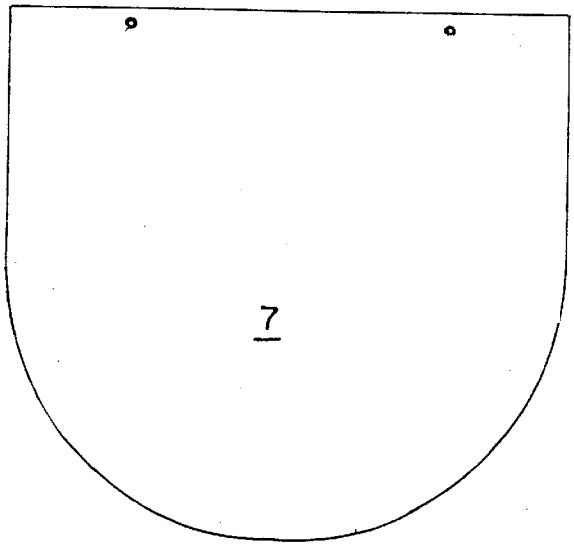
FIG. 3
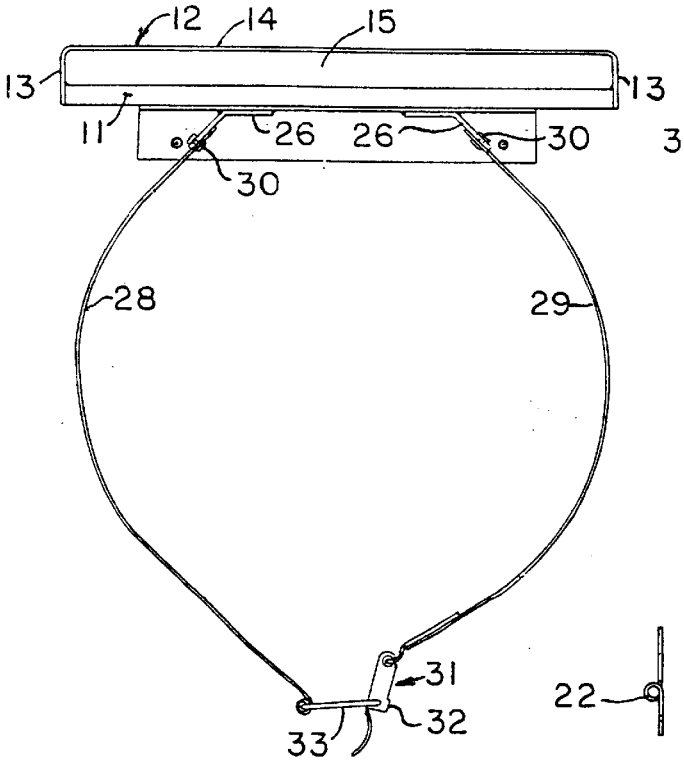
FIG. 5
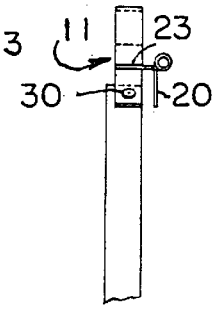
FIG. 6
FIG. 8
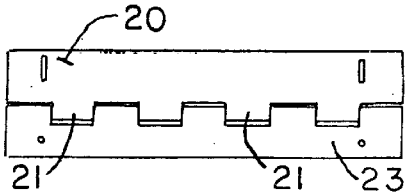
FIG. 7

UTILITY CLOSURE FOR MUD BUCKET

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Composition applied to the joints of dry wall is referred to in the trade as mud, and the containers for it, as mud buckets. In applying mud to dry wall, the workmen applying the mud use a dry wall knife, a somewhat trapezoidal blade with a handle projecting symmetrically from the shorter edge. It is necessary to keep digging the mud out of the bucket. At the same time, it is desirable to keep the open mouth of the bucket covered, and to have some convenient place to put the knife when it is not being used.

The lid that comes with the bucket fits tightly, and if put back on between each trip, is difficult to get off, and must be held in one hand, while the mud is being scooped with the knife, because there is no convenient place to put the lid if the bucket is not on the ground or floor.

One of the objects of this invention is to provide a lid that can be raised easily, and that is connected so as to stay put while open or closed.

Another object is to provide a simple but effective rack or holder for mud knives, that is conveniently located with respect to the bucket.

Other objects will become apparent to those skilled in the art in light of the following description and accompanying drawing.

BRIEF SUMMARY OF THE INVENTION

In accordance with this invention, generally stated, a utility closure for a mud bucket or the like has a rigid bar, a tool holder connected to the bar, a hinge having a leaf carried by the bar and a leaf fastened to the lid, the lid being of a size and shape to cover an open top of the bucket, and means for releaseably fastening the bar to the bucket. In the preferred embodiment, the tool holder is a rack defining a slot dimensioned to receive the blade of a mud knife. In that embodiment, the bucket has a bail, and the lid is dimensioned to project beyond the margin of the open top of the bucket, but to permit the bail to be raised for carrying, the bail frictionally engaging the edges of the lid when the bail is raised. The means for releaseably fastening the bar to the bucket comprises a strap and a toggle buckle mounted to two free ends of the strap. The two ends of the strap can be connected in other ways, as by a hook and loop fastener.

In one embodiment, the lid bar is mounted on the end of a member that is slideably mounted on a complementary substantially vertical post so as to be adjustable to accommodate different heights of bucket. The post is mounted on the bucket by means of a strap with a releaseable fastener. When no post is used, it is desirable that the strap be connected to the bar, which is straight, near the center of the bar, so that the strap embraces the bucket tightly.

BRIEF DESCRIPTION OF THE SEVERAL VIEWS OF THE DRAWINGS

In the drawings.

FIG. 3 is a bottom plan view of one embodiment of lid;

FIG. 4 is a view in edge elevation of FIG. 3;

FIG. 5 is a bottom plan view of the closure assembly of FIGS. 1 and 2, without the lid;

FIG. 6 is a fragmentary view in side elevation of the device shown in FIG. 5;

FIG. 7 is a view one embodiment of hinge;

FIG. 8 is a view in end elevation of FIG. 7;

DETAILED DESCRIPTION OF THE PREFERRED EMBODIMENT

Figure 2:
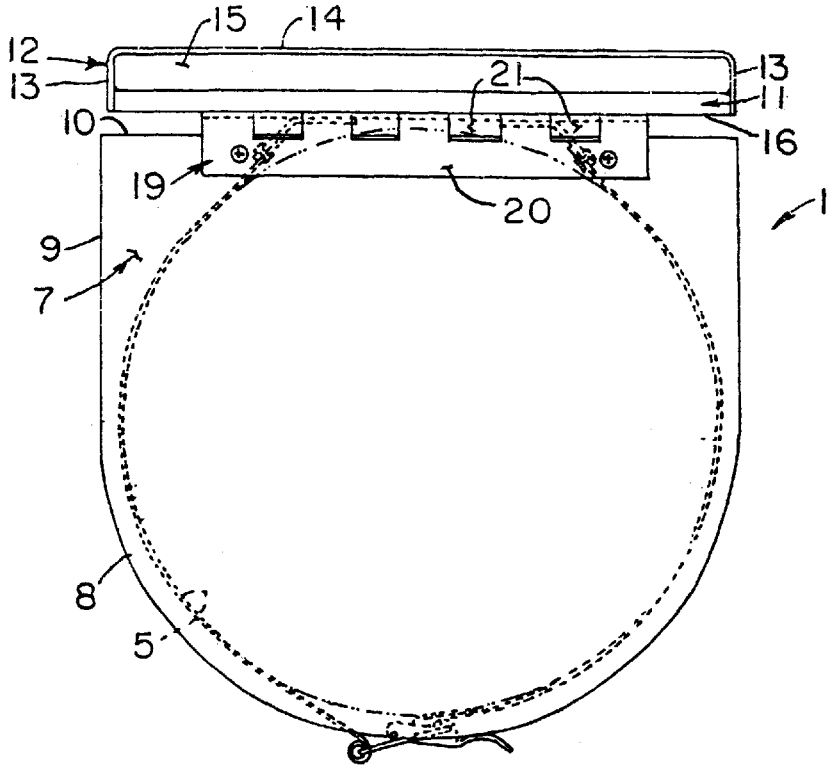
FIG. 2 is a top plan view.
Figure 1:
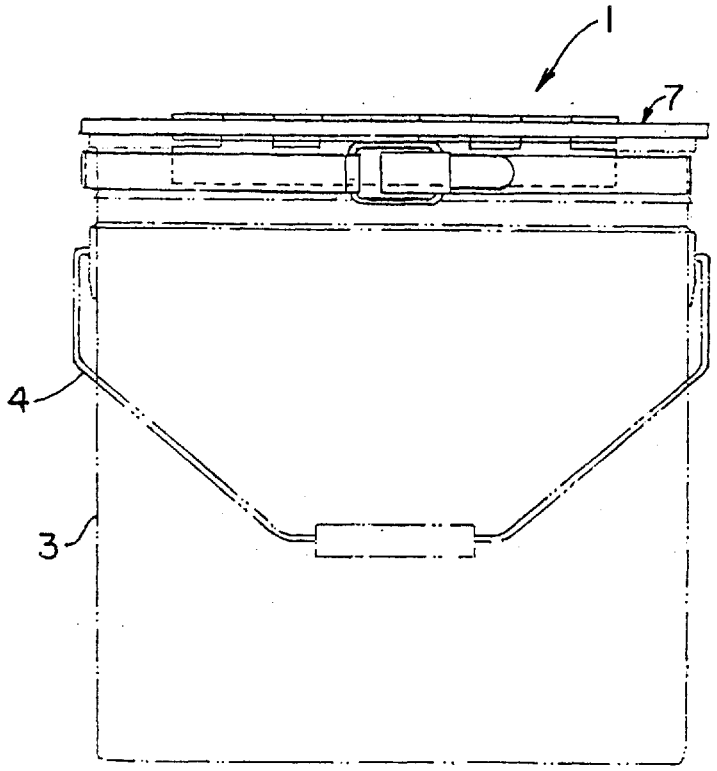
FIG. 1 is a view in side elevation of a mud bucket with one embodiment of utility closure of this invention mounted on it.

Referring now to FIGS. 1 through 7 for one illustrative embodiment of utility closure of this invention, reference 1 indicates a closure assembly installed on a bucket 3. The bucket 3 has a bail 4 and an open mouth 5. The open mouth 5 is covered by a lid 7, with an outer margin 8 projecting beyond the boundaries of the open mouth 5 of the bucket 3. In this embodiment, the outer margin of the lid has a straight side section 9, on each side, the straight side sections 9 being joined at their front edges by an arcuate section complementary in shape to the periphery of the open mouth of the bucket, and at their rear edges, by a straight back margin, as shown particularly in FIG. 2.

A bar 11 is, in this embodiment, square in cross section, as best shown in FIG. 6. The bar 11 serves as one side of a tool holding rack 12. The rest of the rack is made up of legs 13, welded to the two flat ends of the bar 11, and a bridging piece 14 extending between the legs 13 to define with a rear vertical side wall of the bar 11, a tool holding slot 15. Blades of mud knives can be inserted in the slot 15, the handles of the knives resting on upper surfaces of the bridging piece 14 and bar 11. A leaf 23 of a hinge 19 is welded to a front side surface 16 of the bar 11 with knuckles 21 of the hinge extending above the bar. Another leaf 20 of the hinge 19 is fastened to the lid 7, over the straight back edge 10 of the lid, as shown particularly in FIG. 2.

In this embodiment, angle brackets 26 are welded to the leaf 23. Each of the angle brackets 26 has a leg welded to the leaf 23, and another leg extending at an angle from the leaf 23, shown in FIG. 5. Flexible metal straps 28 and 29 are secured at one end, by rivets 30, to the angled legs of the angle brackets 26. The angle brackets are of relatively heavy gauge metal, as compared with the flexible straps 28 and 29. The rivet 30 permits some rotation of the straps 28 and 29 to accommodate a lip on the upper edge of the bucket. At the free end of the strap 28, a link 33 is mounted in an integral loop in the end of the strap 28. The link 33 forms a part of a buckle 31, being linked to a toggle 32. A tab of the buckle is welded to the free end of the strap 29, all as shown in FIG. 5. The buckle itself is conventional and forms no part of the invention.

In installing the closure assembly of this embodiment, the buckle 31 is opened as shown in FIG. 5, to expand the straps 28 and 29 so that they fit easily over the bucket. The assembly is moved down until the lid 7 is flat on the edges of the mouth of the bucket, and the buckle is then tightened, as shown in FIG. 2, to hold the assembly in place. The lid can then be raised around a pintle 22 of the hinge 20, to permit easy access to the contents of the bucket, and restored to the position shown in FIGS. 1 and 2, to protect the contents of the bucket.

The buckle arrangement is entirely satisfactory for standard-sized buckets. However, if the assembly is to accommodate buckets of different diameters, a flexible strap, either of metal or webbing, can be used either with an adjustable buckle or with a hook and loop material (Velcro) on facing surfaces.

Figure 9:
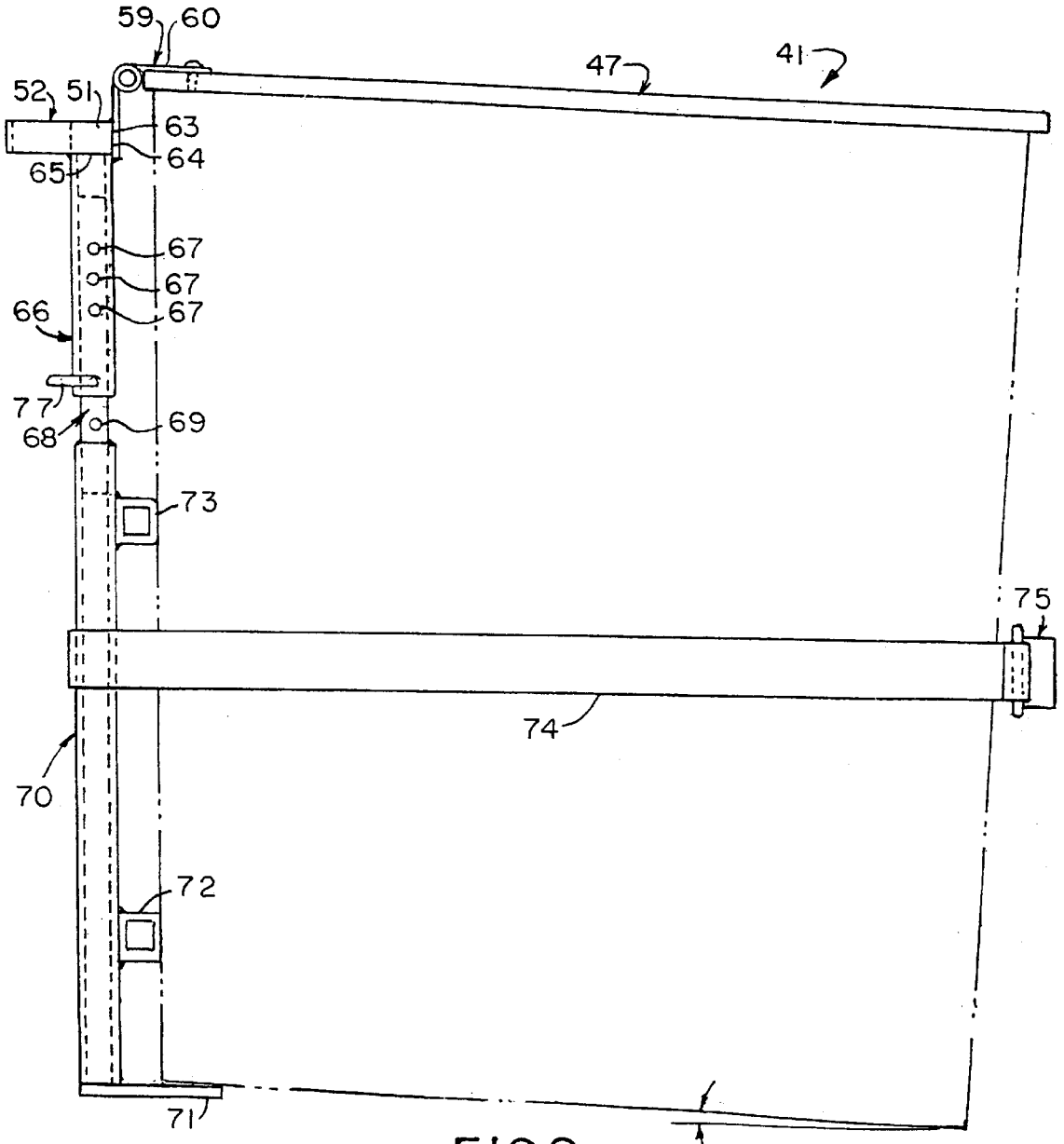
FIG. 9 is a view in side elevation of another embodiment of closure assembly of this invention.
Figure 10:
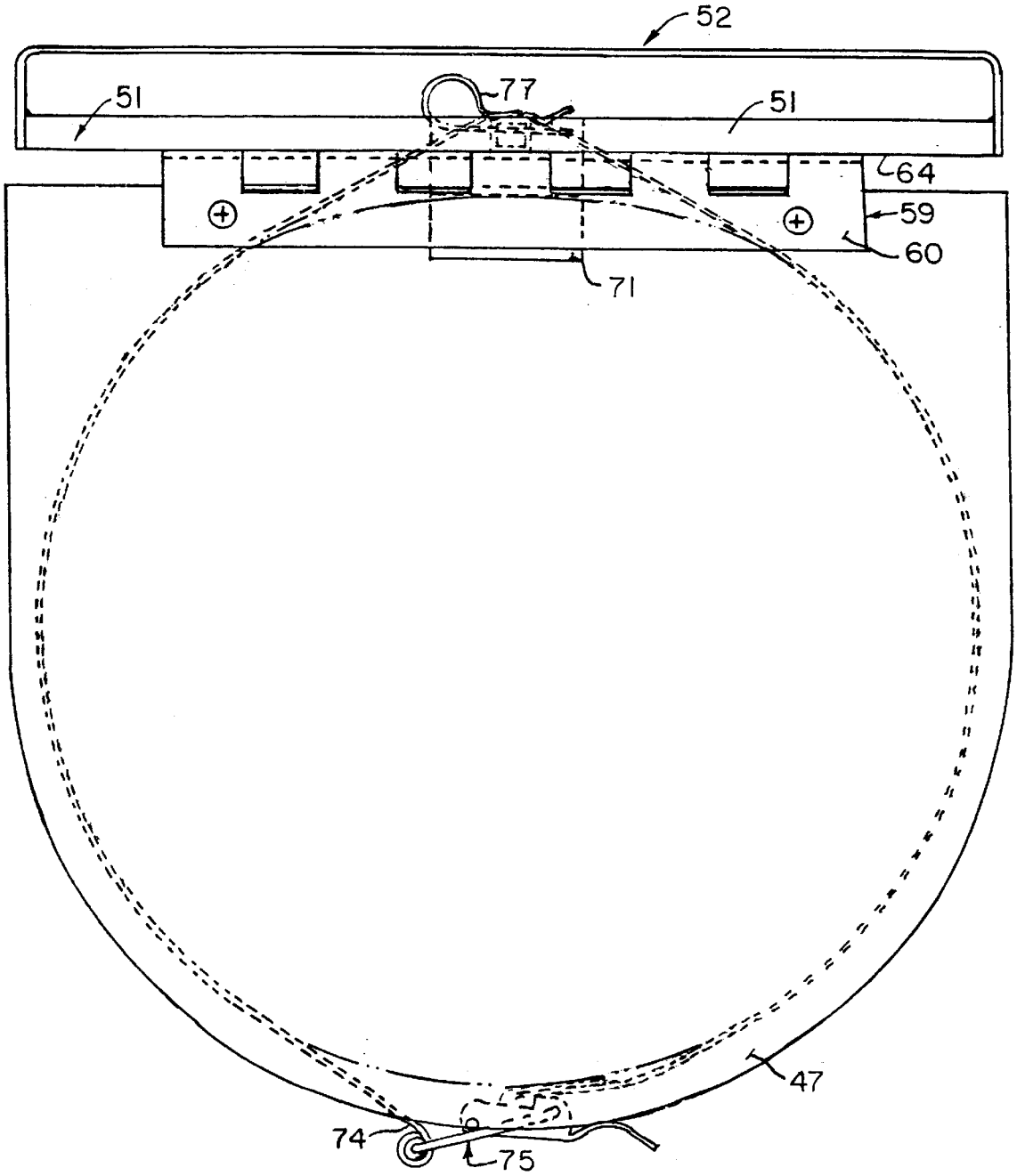
FIG. 10 is a top plan view of the closure assembly shown in FIG. 9.

Referring now to FIGS. 9 and 10 for another embodiment of this invention, reference 41 indicates the closure assembly, with a lid 47, which can be identical to the lid 7, and a bar 51 which, like the bar 11, can be square in cross section. The bar forms a part of and supports a tool holder 52, which can be the same as the tool holder 12 of the first embodiment. A hinge 59 has a leaf 63 welded to a front side surface of the bar 51, and a lid leaf 60, secured to the lid 47.

In this embodiment, a sleeve 66 is welded at an upper end to a bottom surface 65 of the bar, in the center of the bar, as indicated in FIG. 10. The sleeve 66 is slideably mounted on a stanchion or shaft 68, a lower end of which is welded into a post 70. In this embodiment, the sleeve, shaft and post are square in cross section, the sleeve and post being hollow. Passages 67 through sidewalls of the sleeve cooperate with holes 69 in the shaft 68 to receive a Cotter pin 77, whereby the height of the bar 51, hence the lid 47, relative to the bottom of the bucket can be adjusted. As is well known, if the holes 69 are spaced uniformly, a slightly different amount from the passages 67, the height adjustment can be made in small increments, depending upon the differences in spacing of the passages and the holes. In this embodiment, a base plate 71 is welded to the lower end of the post 70, and projects beneath the bottom edge of the bucket, as shown in FIG. 9. Spacers 72 and 73 are welded to the face of the post 70 facing the bucket, to accommodate the hinge 59, as shown in FIG. 9. The assembly 41 is mounted on a bucket by means of a strap 74, which can be continuous between two free ends, welded at the center to the post 70, and the free ends equipped with a buckle 75. As in the first embodiment, the buckle is conventional, and can be replaced with any other suitable releasable fastener.

Numerous variations in the construction of the closure assembly of this invention, within the scope of the appended claims, will occur to those skilled in the art in light of the foregoing disclosure. Merely by way of illustration, the shape of the lid can be varied; the tool rack can be made in the form of a tray, with or without blade-accommodating slots; various stop mechanisms for the lid can be provided, or means to bias the lid in one direction or another. The sleeve and rod of the second embodiment can be reversed, the sleeve taking the form of the rod, and sliding in a sleeve that was formerly the rod. The term "upright" is used herein to cover both forms. Bars 11 and 51 have been described as square in cross section. They or either of them can be rectangular, with two long sides. They have been described as straight, and they should have a straight portion to accommodate the tool holder, but they can be provided with a skirt shaped complementarily to the bucket, to which the straps of the first embodiment can be secured. That skirt can be slotted to accept the leaf of the hinge that is welded to the bar. The bar can be made of a tough, durable plastic, with or without reinforcing fibers or the like. Particularly if the bar and rack are made of plastic, the bar and tool holder can be made in one piece. The holder can be made detachable from the bar. The lid itself can be made of any suitable material, plastic, metal, wood, or composite material. The utility of the closure assembly is not limited to mud buckets, although it has particular application to mud buckets. It can be used, for example, on containers for feed or seed, where the tool holder can be adapted to hold a scoop or the like, and where provision can be made for holding the lid down, either by biasing at the hinge, or by a latch at the front edge of the lid, engaging a complementary element mounted on the container, to inhibit access by vermin. The term "bucket" as used in the claims includes any container to which the device of this invention can be mounted, such as a keg or barrel or pail. The Cotter pin of the second embodiment can be replaced with set screws, wedges or a ratchet type detent. The leaf of the hinge that is secured to the bar can be secured to the top surface of the bar, or even the rear surface, depending upon the positioning of the bar and the extent of the surfaces. These variations are merely illustrative.

SEQUENCE LISTING

Not applicable.

What is claimed is:

1. A utility closure for a mud bucket with a bail, comprising a rigid bar, a tool holder connected to said bar, a hinge having a leaf carried by said bar and a leaf fastened to a lid, said lid being of a size and shape to cover an open top of said bucket, and means for releasably fastening said bar to said bucket.

2. The closure of claim 1 wherein the lid is dimensioned to project beyond the margin of the open top of the bucket but to permit said bail to be raised for carrying.

3. The closure of claim 1 wherein the means for releasably fastening the bar to the bucket comprise a strap and a toggle buckle mounted to and intermediate two ends of said strap.

4. The closure of claim 1 wherein the means for releasably fastening the bar to the bucket comprise angle brackets welded to said hinge leaf carried by said bar and a strap made up of two segments, each having two ends, one of said ends being pivotally mounted on one of said angle brackets, and the other of said ends being connected to a buckle.

5. A utility closure for a bucket comprising a rigid bar having sides, a lid hingedly connected to said bar on one of said sides of said bar, a tool holder connected to a side of said bar opposite said lid, and a retainer mounting said bar on said bucket and dimensioned and constructed releasably to embrace said bucket.

6. The closure of claim 5 wherein the bar is carried by a member slidably mounted on a post for adjustment vertically, said retainer mounting said post on said bucket.

7. A utility closure for a bucket comprising a rigid bar, rectangular in cross section, having two vertical and two horizontal sides, a lid hingedly connected to said bar on one of said vertical sides of said bar, a tool holder carried by said bar on the other of said vertical sides of said bar, said bar being secured to an upright at an upper end of said upright, said upright being slidably mounted for vertical adjustment on a post, means for holding the upright in vertically adjusted position, and a retainer for mounting said post on said bucket.

8. The closure of claim 7 wherein the means for holding the upright in vertically adjusted position comprise passages in said upright and holes in said post, and a cotter pin extending through aligned holes and passages.

9. The closure of claim 7 wherein the upright is a sleeve, and the post comprises a rod projecting vertically upwardly, over which the sleeve is slidably mounted.

10. The closure of claim 9 wherein the post has a hollow lower portion and the upwardly projecting rod is mounted in an open end of the lower portion.

11. The closure of claim 7 wherein the post has a base plate at its lower end to extend under an edge of said bucket.

12. The closure of claim 11 wherein the post has at least one spacer between it and the bucket on which it is mounted.

13. The closure of claim 7 wherein the tool holder is a rack with surfaces defining a knife blade receiving slot.

* * * * *